US007165273B1

(12) United States Patent
Redmond

(10) Patent No.: US 7,165,273 B1
(45) Date of Patent: Jan. 23, 2007

(54) HEADWEAR WITH CUTOUT TO ACCOMMODATE EYEWEAR AND OTHER ITEMS

(76) Inventor: Thomas W. Redmond, P.O. Box 3323, Brentwood, TN (US) 37024

( * ) Notice: Subject to any disclaimer, the term of this patent is extended or adjusted under 35 U.S.C. 154(b) by 0 days.

(21) Appl. No.: 11/277,777

(22) Filed: Mar. 29, 2006

(51) Int. Cl.
*A42B 1/24* (2006.01)

(52) U.S. Cl. ..... 2/209.13

(58) Field of Classification Search ..... 2/195.7, 2/12, 15, 209, 425, 209.3, 423, 171, DIG. 11; 351/123
See application file for complete search history.

(56) References Cited

U.S. PATENT DOCUMENTS 3,237,202 A * 3/1966 Aileo ..... 2/6.5
5,701,610 A * 12/1997 Hsu ..... 2/425

* cited by examiner

*Primary Examiner*—Gary L. Welch
*Assistant Examiner*—Sally Colson Cline
(74) *Attorney, Agent, or Firm*—Galbreath Law Offices, P.C.; John A. Galbreath

(57) ABSTRACT

Headwear is disclosed having a cut-out or opening along the bottom side edges to accommodate eyewear or other items, and eliminate interference in the ear area between the headwear and the eyewear or other item. The cut-out or opening is defined by a headwear bottom side edge that is substantially different and/or higher than the generally smooth, consistent arc seen in the prior art.

14 Claims, 12 Drawing Sheets

HEADWEAR WITH CUTOUT TO ACCOMMODATE EYEWEAR AND OTHER ITEMS

CROSS-REFERENCES TO RELATED APPLICATIONS

Not applicable.

BACKGROUND

1. Field of the Invention

The invention is in the area of headwear.

2. Description of the Related Art

Various forms of headwear, including caps and visors, are known in the prior art. In this prior art headwear, the bottom edge of the sides of the headwear trace a generally smooth, consistent arc from the front to the back of the headwear. This creates a problem when the user also wears glasses, sunglasses, or other items such as earpiece-style headphones or hearing aids—because the bottom edge of the sides of the headwear interfere with the earpiece portion of the eyewear or other item, making for an uncomfortable fit. Often, the user cannot wear his cap in a way that provides the best fit, because doing so interferes with the fit of his eyewear or other item near the ear area.

Recently, eyewear makers have increasingly offered eyewear with "straight frame" earpieces that sit higher on the head, thereby exacerbating the interference issue between the headwear and the eyewear. Such eyewear designs are considered more stylish, and have becomes very popular. In addition, depending on the size, shape, and location of a user's ears, the side portions of headwear can interfere with the ears themselves. This makes for an uncomfortable fit of the cap against the head, even without eyewear.

SUMMARY OF THE INVENTION

The invention is headwear with a cut-out or opening along the bottom side edges to accommodate eyewear or other items, and eliminate interference in the ear area between the headwear and the eyewear or other item. The cut-out or opening does not detract from the fit of the headwear, because when covering the outside of an elliptical or oval shape such as a user's head, the pressure is primarily in the area of the long ends of the ellipse—that is, the front and back of the head, and not the sides. Thus, a cut-out or opening on the bottom side edge of the headwear does not significantly disturb the fit or feel of the headwear.

Several objects and advantages of the invention are:

It is an object of the invention to provide a device that prevents interference between the bottom side portions of headwear and eyewear or other items worn in, on, or around the ear area.

It is a further object of the invention to provide a device that prevents interference between the bottom side portions of headwear and the ear itself.

It is a further object that the invention can be implemented on many different types of headwear, and can prevent interference with many different types of eyewear or other items.

It is yet another object of the invention to provide a device that is relatively easy and cost-effective to manufacture.

Further objects and advantages of the invention will become apparent from a consideration of the ensuing description and drawings.

DETAILED DESCRIPTION OF THE INVENTION

Figure 1:
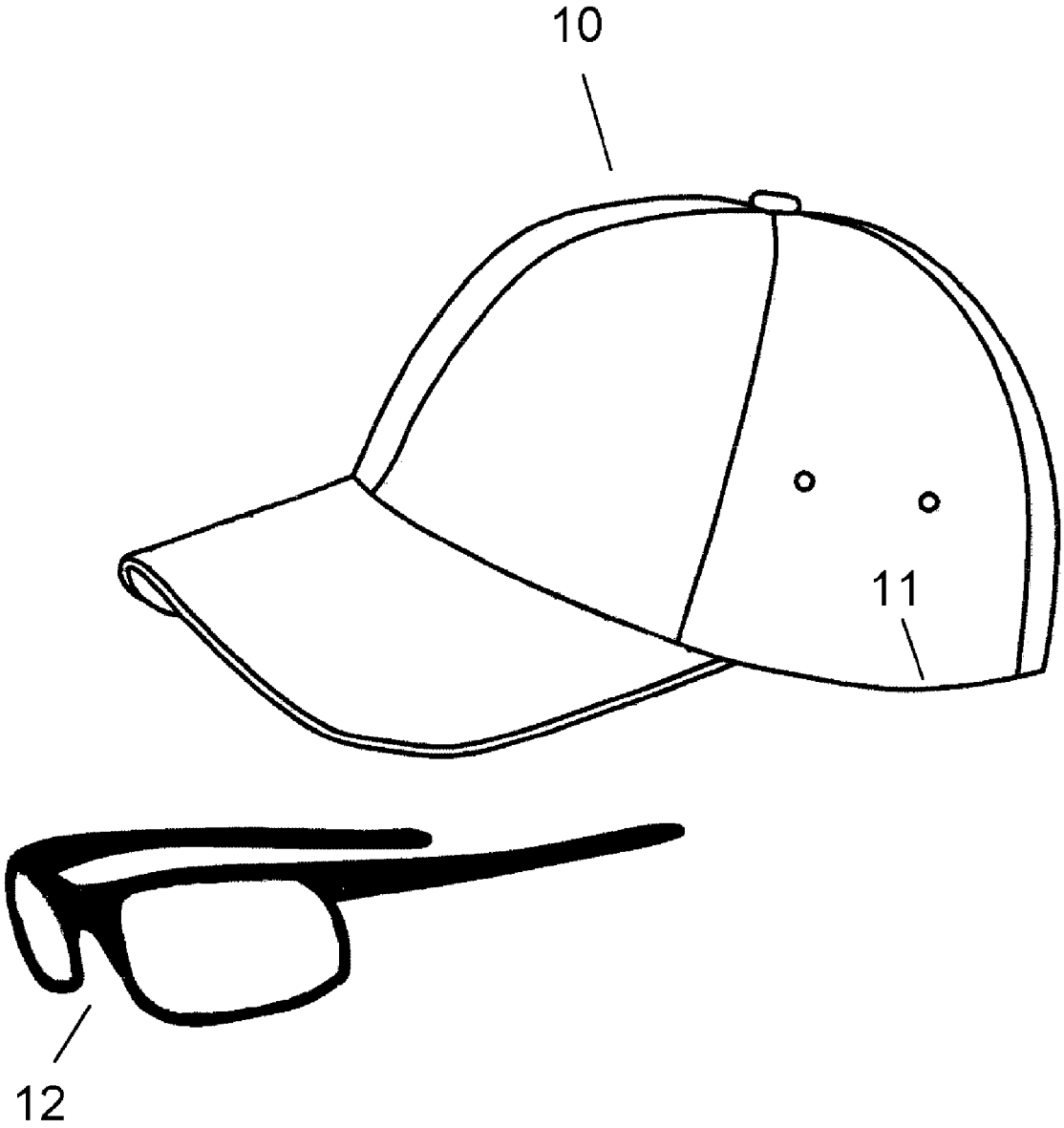
FIGURE 1 (Prior Art)
FIG. 1 is a perspective view of a conventional cap known in the art, and having a smooth, uninterrupted arc along the bottom side edge.

The following provides a list of the reference characters used in the drawings:

10. Cap
11. Cap bottom left side edge (prior art)
12. Eyewear
13. Left earpiece
14. Visor
15. Visor bottom left side edge (prior art)
16. Inner headband
17. Cap bottom left side edge (invention)
18. Cap left side cut-out

Figure 2:
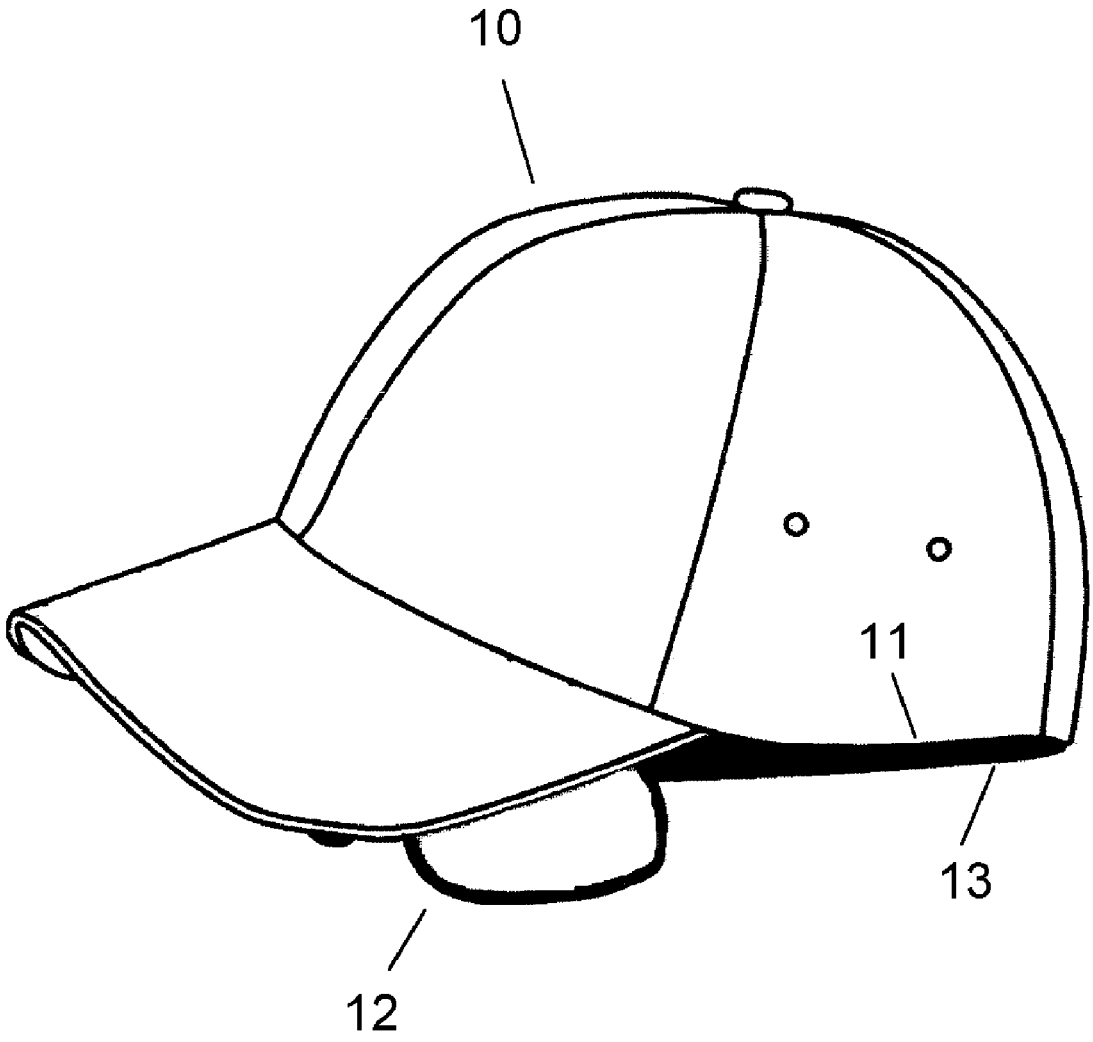
FIGURE 2 (Prior Art)
FIG. 2 is a perspective view of the prior art cap shown in FIG. 1, wherein the earpiece of an eyewear article interferes with the bottom side edge of the cap.
Figure 3:
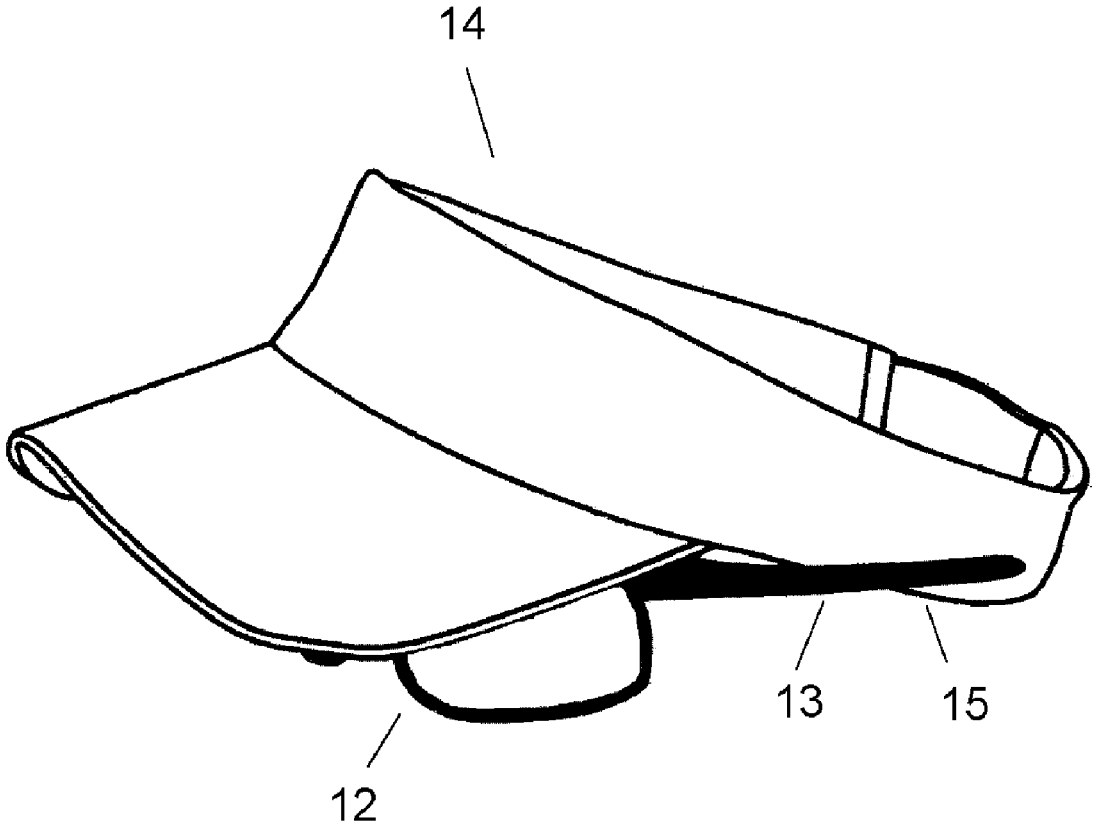
FIGURE 3 (Prior Art)
FIG. 3 is a perspective view of a conventional visor known in the art, and having a smooth, uninterrupted arc along the bottom side edge. The earpiece of an eyewear article interferes with the bottom side edge of the visor.

19. Visor bottom left side edge (invention)
20. Visor left side cut-out
21. Right earpiece
22. Cap bottom right side edge (invention)
23. Cap right side cut-out
24. Visor bottom right side edge (invention)
25. Visor right side cut-out FIGS. 1–3 illustrate prior art headwear, and demonstrate the eyewear interference issue that the present invention solves. FIG. 1 shows a conventional cap 10, which has a smooth, uninterrupted arc along cap bottom left side edge 11. Eyewear 12 is also illustrated. FIG. 2 shows cap 10 with eyewear 12 in place as it would be worn by a person. It can be seen that left earpiece 13 of eyewear 12 interferes with cap bottom left side edge 11 of cap 10. In other words, it is difficult to don eyewear 12 and place left earpiece 13 over the ear, because cap bottom left side edge 11 (which rests against the head) comes down too close to the ear, and prevents left earpiece 13 from being placed over the ear. Often, in order to fit, left earpiece 13 must rest over cap 10's lower left side portion, above cap bottom left side edge 11. This is uncomfortable, and negatively influences the fit and feel of both cap 10 and eyewear 12. Moreover, as cap 10 shifts on the user's head during normal activity, cap 10 shifts the position of left earpiece 13 and thus eyewear 12, which is distracting and uncomfortable.

FIG. 3 shows a conventional visor 14, also having a smooth, uninterrupted arc along visor bottom left side edge 15. As with the cap, left earpiece 13 of eyewear 12 interferes with visor bottom left side edge 15. In order to fit, left earpiece 13 must rest over visor 14's lower left side portion, above visor bottom left side edge 15. This causes the same fit and comfort problems discussed above.

Figure 4:
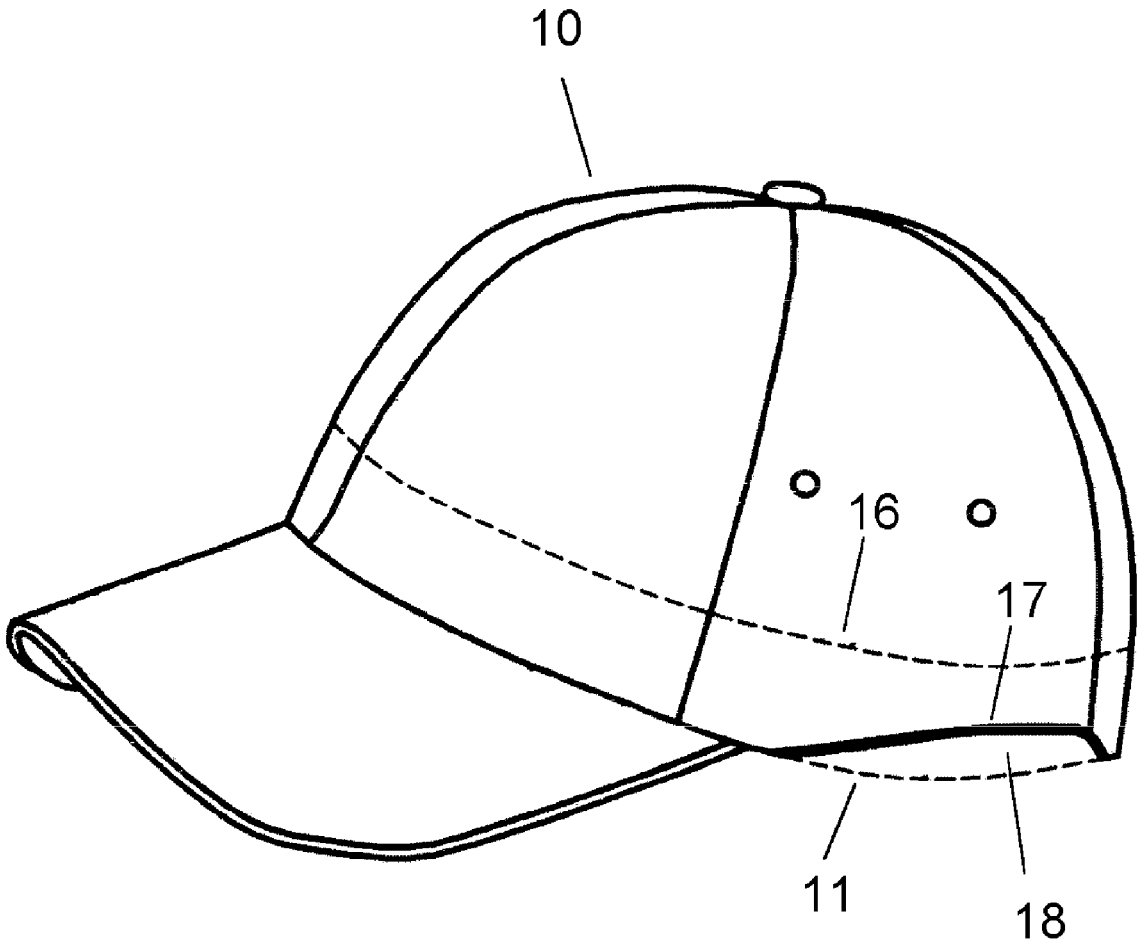
FIG. 4 is a perspective view of the headwear of the invention in the form of a cap, the cap having a cut-out or opening along the bottom side edge to accommodate eyewear or other items, and eliminate interference in the ear area between the cap and the eyewear or other item. Note that the bottom side edge arc of a conventional cap is indicated with a dashed line, in order to clearly illustrate the cutout or opening in the cap of the invention.

FIG. 4 shows the headwear of the invention in the form of a cap 10. In sharp contrast to the conventional cap illustrated in FIGS. 1 and 2, this cap 10 has a cap bottom left side edge 17 that is substantially different and/or higher than the cap bottom left side edge 11 seen in the prior art, thereby creating a cap left side cut-out 18 along the bottom left side edge portion of cap 10. Note that cap bottom left side edge 11, of the conventional cap shown in FIGS. 1 and 2, is indicated in FIG. 4 with a dashed line. This clearly illustrates the difference between cap bottom left side edge 11 in a conventional cap and cap bottom left side edge 17 in the cap of the invention, thus accentuating cap left side cut-out 18. Cap 10 also has an inner headband 16, and it should be understood that in the invention, the bottom edge of inner headband 16 is also cut-out versus a conventional cap, such that inner headband 16 does not interfere with eyewear 12, other items worn in the ear area, or even the ear itself.

Figure 5:
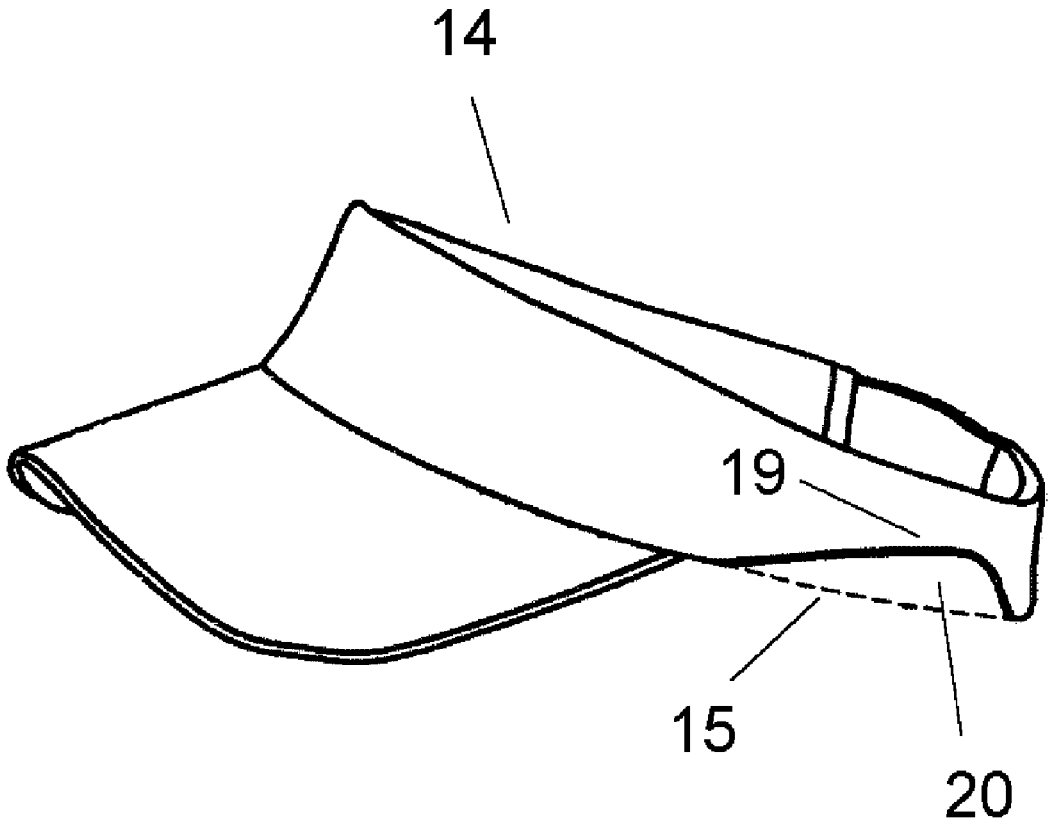
FIG. 5 is a perspective view of the headwear of the invention in the form of a visor, the visor having a cut-out or opening along the bottom side edge to accommodate eyewear or other items, and eliminate interference in the ear area between the visor and the eyewear or other item. Note that the bottom side edge arc of a conventional visor is indicated with a dashed line, in order to clearly illustrate the cutout or opening in the visor of the invention.

FIG. 5 shows the headwear of the invention in the form of visor 14. In sharp contrast to the conventional visor illustrated in FIG. 3, this visor 14 has a visor bottom left side edge 19 that is substantially different and/or higher than the visor bottom left side edge 15 seen in the prior art, thereby creating a visor left side cut-out 20 along the bottom left side edge portion of visor 14. Note that visor bottom left side edge 15, of the conventional visor shown in FIG. 3, is indicated in FIG. 5 with a dashed line. This clearly illustrates the difference between visor bottom left side edge 15 in a conventional visor and visor bottom left side edge 19 in the visor of the invention, thus accentuating visor left side cut-out 20.

Figure 6:
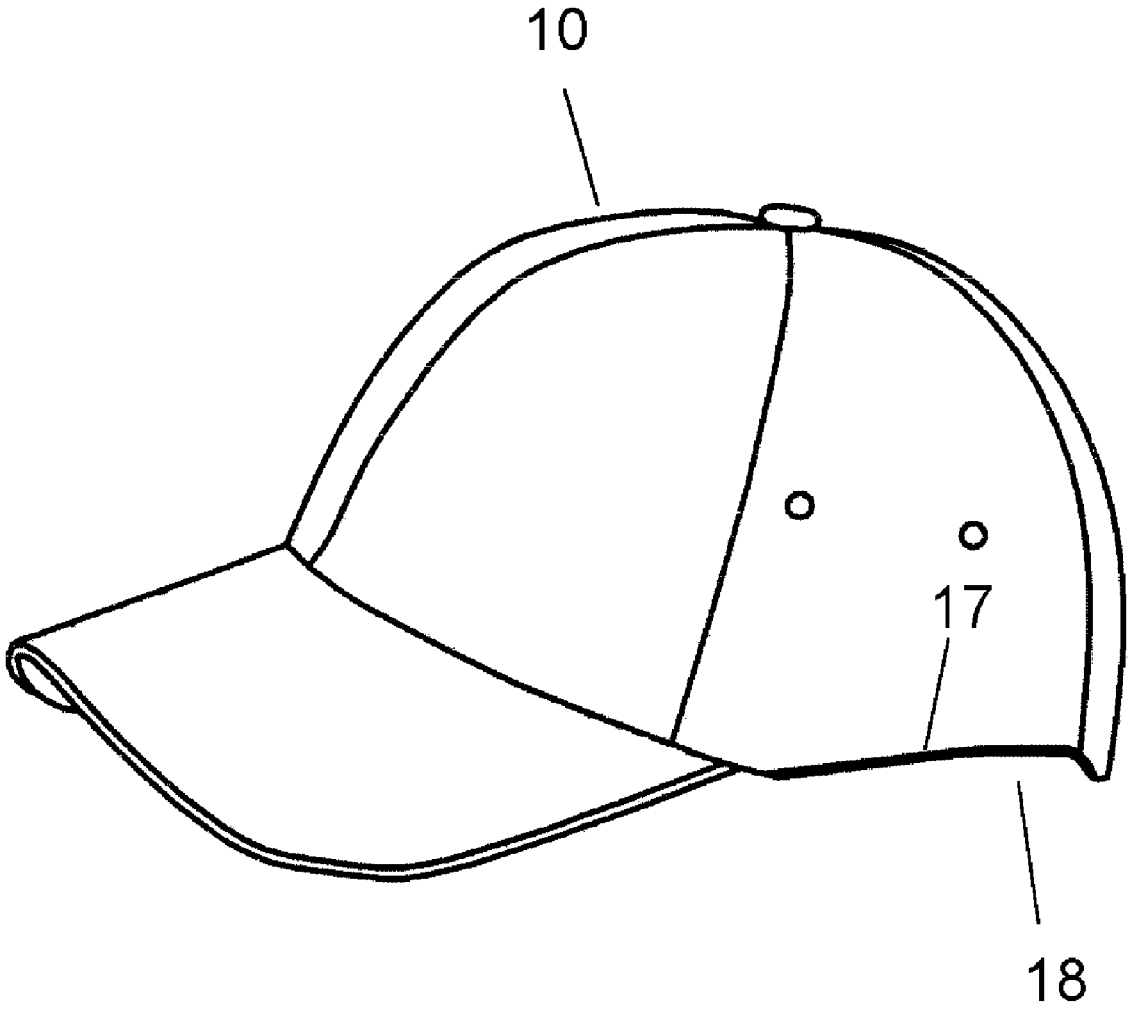
FIG. 6 is a perspective view of the cap shown in FIG. 4, without the dashed line that indicates the bottom side edge arc of a conventional cap.
Figure 7:
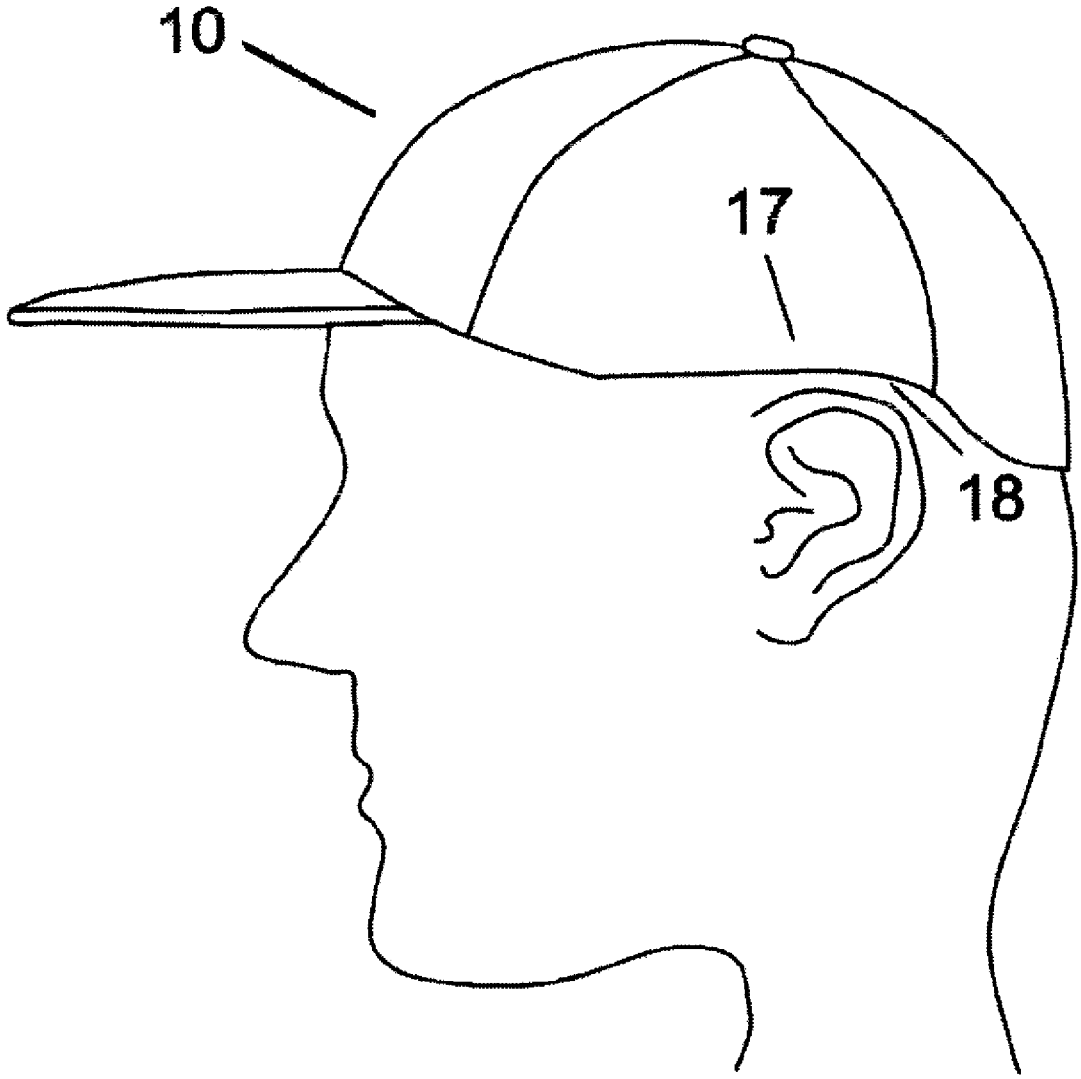
FIG. 7 is a side view of the cap shown in FIG. 6, as worn on the head of a user.
Figure 8:
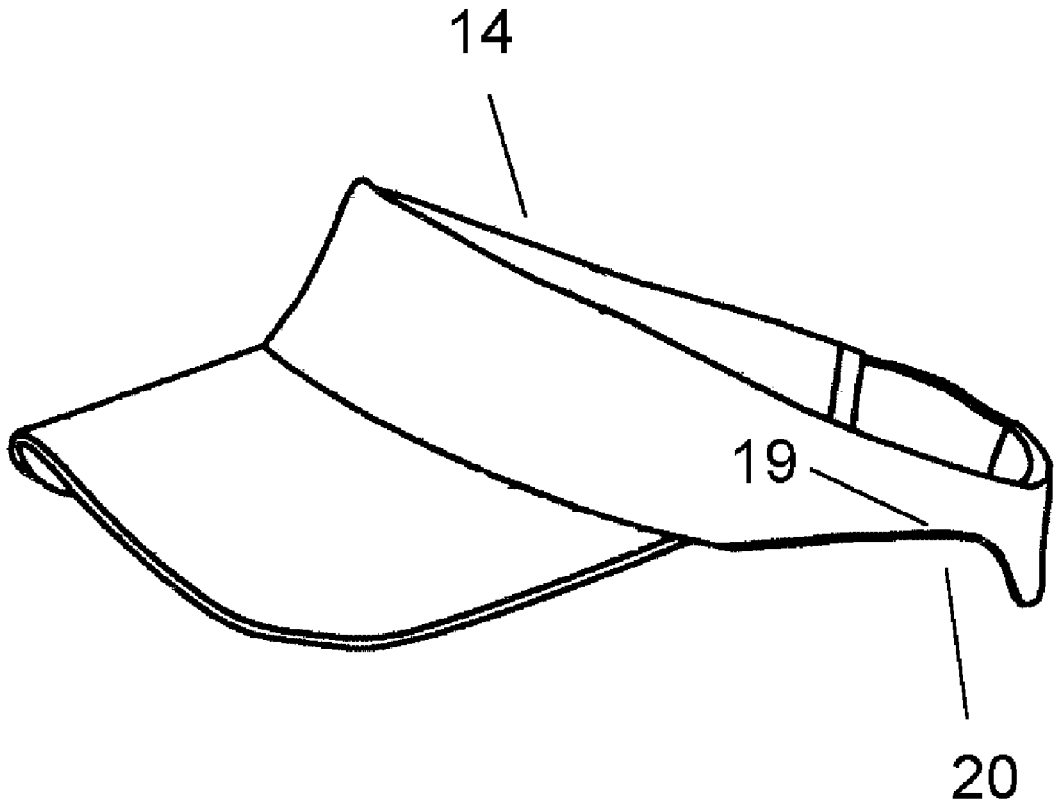
FIG. 8 is a perspective view of the visor shown in FIG. 5, without the dashed line that indicates the bottom side edge arc of a conventional visor.

FIGS. 6 and 7 illustrate the cap shown in FIG. 4 in perspective and side view respectively, but without the dashed line that indicates cap bottom left side edge 11 in a conventional cap. Similarly, FIG. 8 illustrates the visor shown in FIG. 5, without the dashed line that indicates visor bottom left side edge 15 in a conventional visor. As seen in FIG. 7, when cap 10 is worn by a user, cap left side cut-out 18 is substantially proximate to the user's ear. Cap left side cut-out 18 creates a space above and around the ear, so that earpieces of eyewear, or other items, do not interfere with headwear. Although not shown in the figures, it can be understood that visor left side cut-out 20 is also substantially proximate to the user's ear when the visor is worn.

Figure 9:
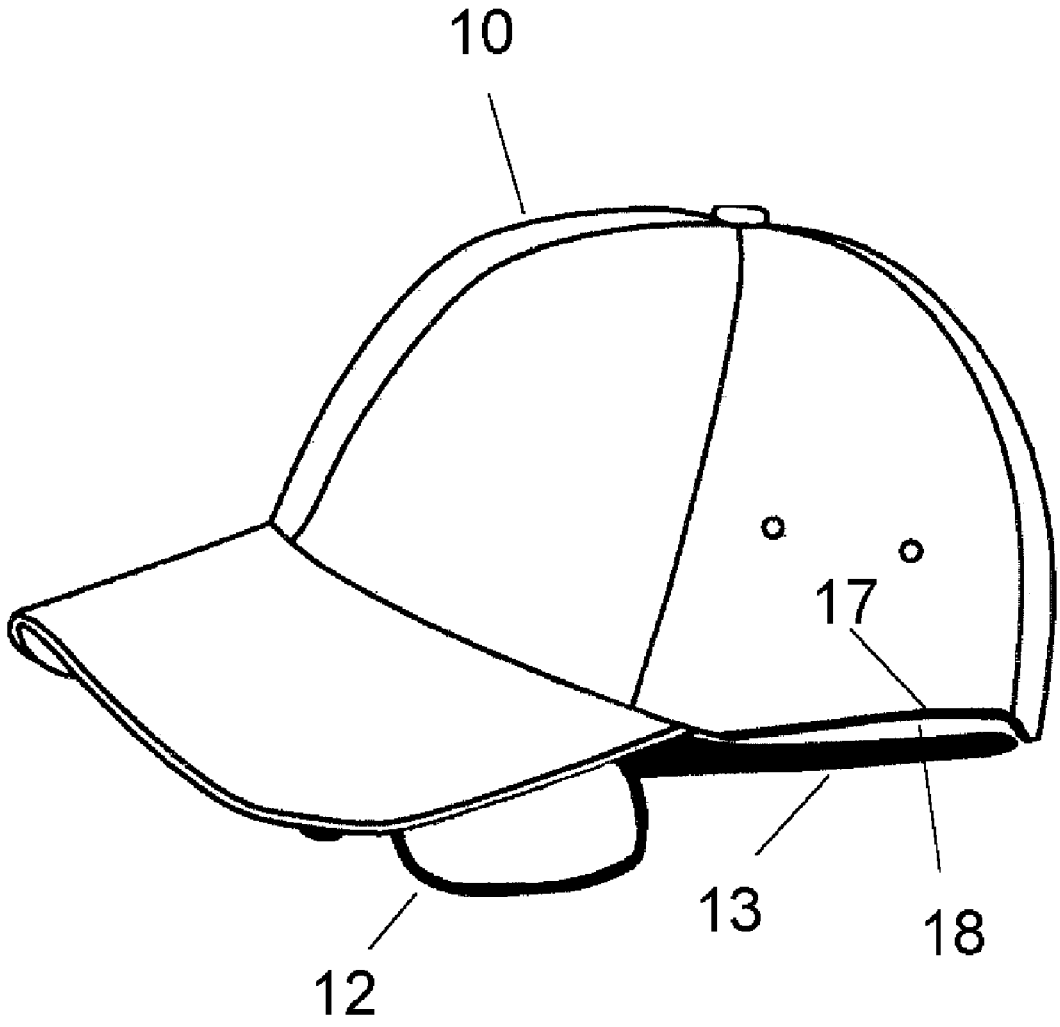
FIG. 9 is a perspective view of the cap shown in FIG. 6, wherein the earpiece of an eyewear article fits into the cut-out or opening, and thus does not interfere with the bottom side edge of the cap.

FIG. 9 further illustrates the cap of FIG. 6, but with eyewear 12 in place as it would be worn by a person. Left earpiece 13 of eyewear 12 fits into cap left side cut-out 18. It can be appreciated that cap left side cut-out 18 serves to accommodate eyewear 12 or other items worn in the ear area, and eliminate interference in the ear area between cap 10 and eyewear 12 or another item.

Figure 10:
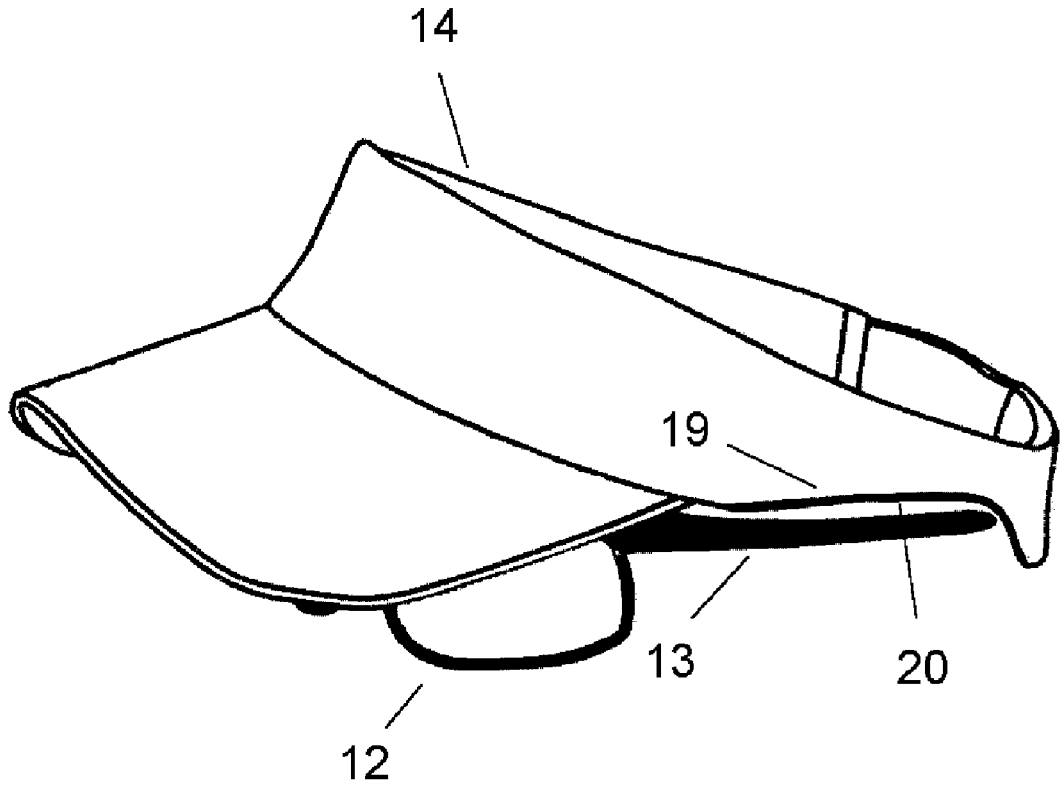
FIG. 10 is a perspective view of the visor shown in FIG. 8, wherein the earpiece of an eyewear article fits into the cut-out or opening, and thus does not interfere with the bottom side edge of the visor.

FIG. 10 further illustrates the visor of FIG. 8, but with eyewear 12 in place as it would be worn by a person. Left earpiece 13 of eyewear 12 fits into visor left side cut-out 20. It can be appreciated that visor left side cut-out 20 serves to accommodate eyewear 12 or other items worn in the ear area, and eliminate interference in the ear area between visor 14 and eyewear 12 or another item.

Figure 11:
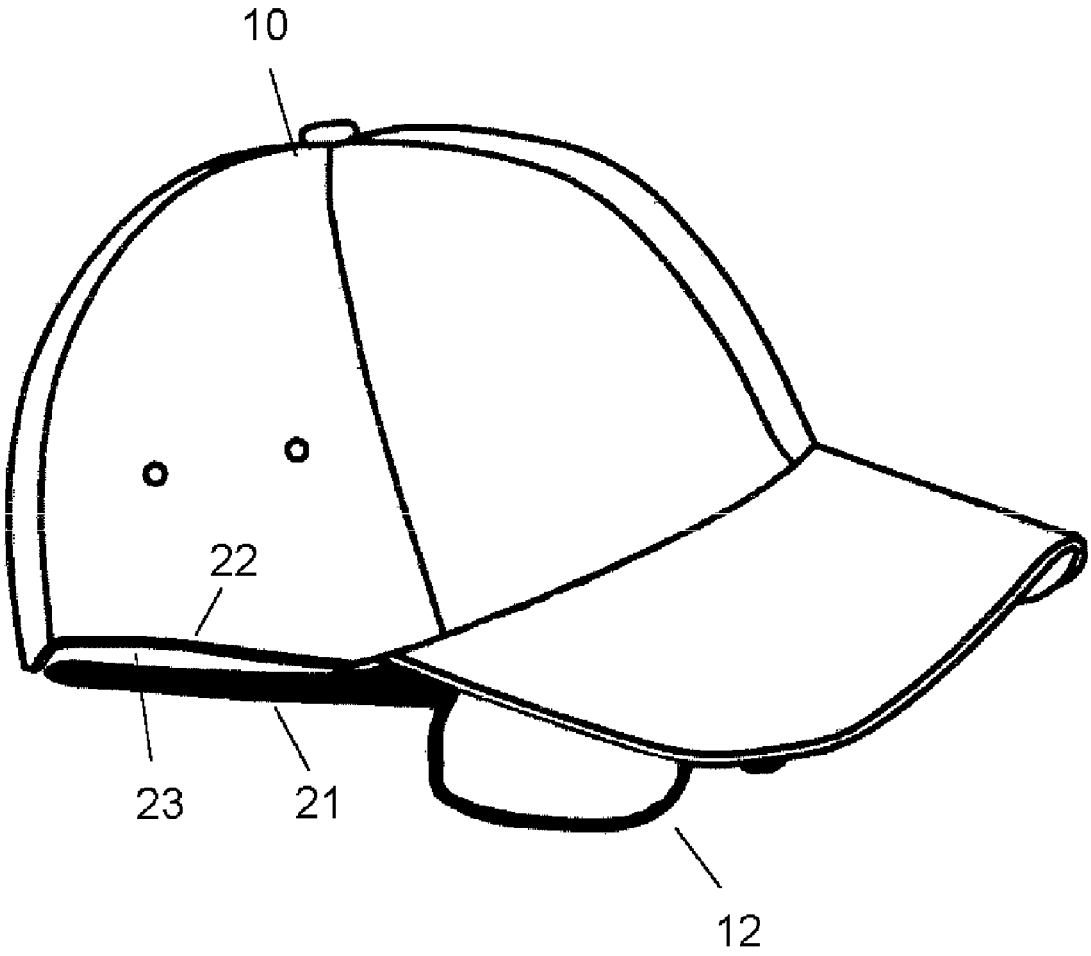
FIG. 11 is a perspective view of the other (right) side of the cap shown in FIG. 6, wherein the other (right) earpiece of an eyewear article fits into the cut-out or opening, and thus does not interfere with the bottom side edge of the cap.
Figure 12:
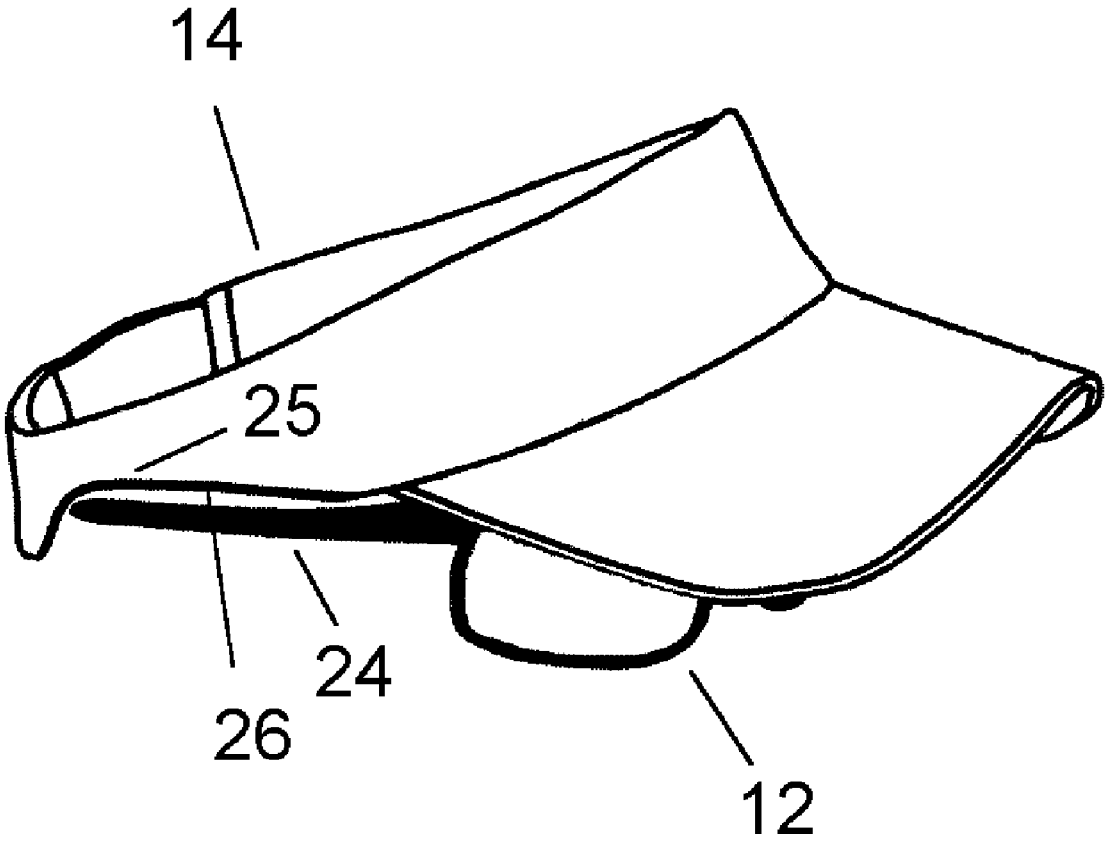
FIG. 12 is a perspective view of the other (right) side of the visor shown in FIG. 8, wherein the other (right) earpiece of an eyewear article fits into the cut-out or opening, and thus does not interfere with the bottom side edge of the visor.

FIG. 11 illustrates the other (right) side of the cap 10 shown in FIG. 6. Right earpiece 21 of eyewear 12 fits into cap right side cut-out 23, and right earpiece 21 thus does not interfere with cap bottom right side edge 22 of cap 10. Similarly, FIG. 12 illustrates the other (right) side of the visor 14 shown in FIG. 8. Right earpiece 21 of eyewear 12 fits into visor right side cut-out 25, and right earpiece 21 thus does not interfere with visor bottom right side edge 24 of visor 14. FIG. 12 is a perspective view of the other (right) side of the visor shown in FIG. 8, wherein the other (right) earpiece of an eyewear article fits into the cut-out or opening, and thus does not interfere with the bottom side edge of the visor.

While the above descriptions contain many specificities, these shall not be construed as limitations on the scope of the invention, but rather as exemplifications of embodiments thereof. Many other variations are possible without departing from the spirit of the invention. Examples of just a few of the possible variations follow:

The size and shape of the cut-out can vary, in order to accommodate different-sized items that are placed in the ear area.

Only one side (left or right) can have the cut-out, rather than both sides as described above.

It should be understood that "cut-out" is used as a convenient term to describe the opening at the lower side portion of the headwear, and "cut-out" should not be taken to mean that the invention must be made by literally cutting out the lower side portion of existing headwear. Although this certainly could be done, it can be appreciated that the invention can also be made via a pattern that incorporates the cut-out. Thus, "cut-out" should be understood to simply mean an opening in the lower side portion of the headwear that prevents interference between the headwear and eyewear or other items, or that prevents interference between the headwear and the ear itself. The invention can be implemented on other forms of headwear, besides the cap and visor shown and described. As just one example, it can be implemented on cap and visor styles that do not have a closed back or a strap completely across the back, but instead have two side members that "clamp" the head to hold the cap or visor on. The claim language that follows is intended to encompass such headwear styles.

The invention can be implemented to prevent interference with other forms, sizes, and styles of eyewear, besides the eyewear shown and described. It can also be implemented to prevent interference with other articles worn in, on, or around the ear area, including for example items such as earpiece-style headphones, hearing aids, etc.

Accordingly, the scope of the invention should be determined not by the embodiments illustrated, but by the appended claims and their legal equivalents.

What is claimed is:

1. An article of headwear, comprising:

(a) a main body adapted to at least partially cover a user's head, said main body including front, side, and rearward portions;

(b) an opening at a bottom edge of said side portion; the bottom edge of said side portion subscribing a substantially smooth arc from said front portion to said rearward portion except for said opening;

(c) said opening defined by a gap between said bottom edge of said side portion at said opening and said substantially smooth arc; said opening being between said front portion and said rearward portion;

whereby said headwear does not interfere with eyewear or other items worn on the user's head.

2. The headwear of claim 1, wherein said headwear is a cap.

3. The headwear of claim 2, wherein said cap has a bottom circumference substantially surrounding the user's head, and a bill extending from said bottom circumference.

4. The headwear of claim 1, wherein said headwear is a visor.

5. The headwear of claim 4, wherein said visor has a bottom circumference substantially surrounding the user's head, and a bill extending from said bottom circumference.

6. The headwear of claim 1, wherein said opening has a shape, from said front portion to said rearward portion, defined by a gradual incline away from said arc to a point proximate to the user's ear, and then a steeper decline back to said arc rearward of the user's ear.

7. The headwear of claim 1, wherein said headwear has left and right side portions, with one said opening located at a bottom edge of said left side portion and one said opening located at a bottom edge of said right side portion.

8. An article of headwear, comprising:

(a) a main body adapted to at least partially cover a user's head, said main body including front, side, and rearward portions;

(b) a bottom edge of said side portion, said bottom edge of said side portion being indented from an arc described between a bottom edge of said front portion and a bottom edge of said rearward portion; said indentation tapering smoothly from a narrower extent at said front portion of said main body to a wider extent at said rearward portion; said indentation being between said front portion and said rearward portion;

whereby said headwear does not interfere with eyewear or other items worn on the user's head.

9. The headwear of claim 8, wherein said headwear is a cap.

10. The headwear of claim 9, wherein said cap has a bottom circumference substantially surrounding the user's head, and a bill extending from said bottom circumference.

11. The headwear of claim 8, wherein said headwear is a visor.

12. The headwear of claim 11, wherein said visor has a bottom circumference substantially surrounding the user's head, and a bill extending from said bottom circumference.

13. The headwear of claim 8, wherein said bottom edge of said side portion, from said front portion to said rearward portion, moves gradually away from said arc to a point proximate to the user's ear, and then declines more steeply back to said arc rearward of the user's ear.

14. The headwear of claim 8, wherein said headwear has left and right side portions, with a bottom edge of said left side portion being indented and a bottom edge of said right side portion being indented.

* * * * *

US007165273C1

(12) EX PARTE REEXAMINATION CERTIFICATE (7208th)

United States Patent
Redmond

(10) Number: US 7,165,273 C1
(45) Certificate Issued: Dec. 1, 2009

(54) HEADWEAR WITH CUTOUT TO ACCOMMODATE EYEWEAR AND OTHER ITEMS

(76) Inventor: Thomas W. Redmond, P.O. Box 3323, Brentwood, TN (US) 37024

Reexamination Request:
No. 90/010,040, Oct. 19, 2007

Reexamination Certificate for:

| | |
|---|---|
| Patent No.: | **7,165,273** |
| Issued: | **Jan. 23, 2007** |
| Appl. No.: | **11/277,777** |
| Filed: | **Mar. 29, 2006** |

(51) Int. Cl.
*A42B 1/24* (2006.01)

(52) U.S. Cl. ..... 2/209.13
(58) Field of Classification Search ..... 2/209.12; D2/882
See application file for complete search history.

(56) References Cited

U.S. PATENT DOCUMENTS

| | | | | | |
|---|---|---|---|---|---|
| D498,572 | S | * | 11/2004 | Si | D2/882 |
| D501,705 | S | * | 2/2005 | Hathaway | D2/893 |
| D517,781 | S | | 3/2006 | Ortley et al. | |
| D535,460 | S | | 1/2007 | Ortley | |

* cited by examiner

*Primary Examiner*—Catherine S. Williams

(57) ABSTRACT

Headwear is disclosed having a cut-out or opening along the bottom side edges to accommodate eyewear or other items, and eliminate interference in the ear area between the headwear and the eyewear or other item. The cut-out or opening is defined by a headwear bottom side edge that is substantially different and/or higher than the generally smooth, consistent arc seen in the prior art.

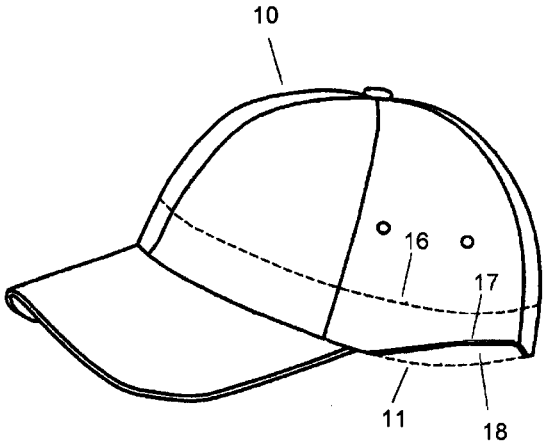

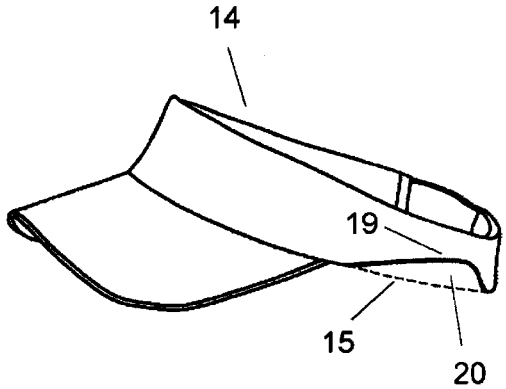

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–14 are cancelled.

* * * * *